US008291722B2

(12) United States Patent
Lurtz

(10) Patent No.: US 8,291,722 B2
(45) Date of Patent: Oct. 23, 2012

(54) GENERATOR USING GRAVITATIONAL AND GEOTHERMAL ENERGY

(76) Inventor: Jerome R. Lurtz, Oakland, MI (US)

( * ) Notice: Subject to any disclaimer, the term of this patent is extended or adjusted under 35 U.S.C. 154(b) by 872 days.

(21) Appl. No.: 12/418,203

(22) Filed: Apr. 3, 2009

(65) Prior Publication Data

US 2009/0229787 A1 Sep. 17, 2009

Related U.S. Application Data

(60) Continuation-in-part of application No. 11/689,110, filed on Mar. 21, 2007, now Pat. No. 7,841,082, which is a continuation-in-part of application No. 11/342,772, filed on Jan. 30, 2006, which is a division of application No. 10/426,419, filed on Apr. 30, 2003.

(60) Provisional application No. 61/043,616, filed on Apr. 9, 2008, provisional application No. 60/380,101, filed on May 6, 2002.

(51) Int. Cl.
*F25D 23/12* (2006.01)

(52) U.S. Cl. ..... 62/260; 62/324.1

(58) Field of Classification Search ..... 62/260, 62/235.1, 324.1, 324.6; 165/45
See application file for complete search history.

(56) References Cited

U.S. PATENT DOCUMENTS

| | | | | |
|---|---|---|---|---|
| 669,000 | A | 2/1901 | Peck | |
| 725,412 | A | 4/1903 | Cornell | |
| 926,641 | A | 6/1909 | Coffey | |
| 1,052,045 | A | 2/1913 | Doedyns | |
| 2,920,610 | A | 1/1960 | Brelle | |
| 3,297,006 | A | 1/1967 | Marshall | |
| 4,057,035 | A | 11/1977 | Su | |
| 4,457,680 | A | 7/1984 | Paget | |
| 5,237,827 | A * | 8/1993 | Tchernev | 62/106 |
| 6,129,067 | A | 10/2000 | Riley | |
| 6,132,197 | A | 10/2000 | Adamovski | |
| 6,250,277 | B1 | 6/2001 | Adamovski | |
| 6,352,420 | B1 | 3/2002 | Shen | |
| 6,488,004 | B1 | 12/2002 | Adamovski | |
| 6,644,062 | B1 * | 11/2003 | Hays | 62/402 |

FOREIGN PATENT DOCUMENTS

| | | |
|---|---|---|
| AU | 478430 | 4/1973 |
| WO | WO91/02888 | 3/1991 |

OTHER PUBLICATIONS

International Search W Report dated Sep. 4, 2003 for PCT/US03/13786, filed May 3, 2003.

* cited by examiner

*Primary Examiner* — Melvin Jones
(74) *Attorney, Agent, or Firm* — Simmons Perrine Moyer Bergman, PLC

(57) ABSTRACT

The present invention is an apparatus that includes a chamber rotor with a chamber and an extension rotor with an extension. The rotors are housed in a rotor case. A pressure cavity is at least transiently formed by the extension rotor and the chamber rotor. The present invention also includes a compressor that includes a chamber rotor with a chamber and an extension rotor with an extension where the extension is adapted to be received in the chamber when the rotors are synchronously rotated. The compressor also includes a power input shaft attached to the extension rotor and a gear assembly attached to the rotors that is adapted to insure the synchronous rotation of the rotors. A rotor case houses the rotors and has an intake port and an exhaust port. The present invention also includes an engine that is similar to the compressor and includes a spark plug. Methods of compressing, pumping and generating electricity and mechanical power are also part of the present invention.

20 Claims, 10 Drawing Sheets

GENERATOR USING GRAVITATIONAL AND GEOTHERMAL ENERGY

RELATED APPLICATIONS

This application claims the benefit of U.S. Patent Application 61/043,616, filed on Apr. 9, 2008 and is a continuation in part of U.S. patent application Ser. No. 11/689,110, filed on Mar. 21, 2007, now U.S. Pat. No. 7,841,082, which is a continuation in part of U.S. patent application Ser. No. 11/342,772, filed on Jan. 30, 2006, which is a divisional of U.S. patent application Ser. No. 10/426,419, filed on Apr. 30, 2003, which in turn claims benefit of U.S. provisional application No. 60/380,101, filed May 6, 2002.

FIELD OF THE INVENTION

This invention relates to improved non-eccentric devices such as pumps, compressors, and especially engines. The present invention also relates to a gravity fed apparatus that uses geothermal energy to generate electricity and heat and to a Sterling engine utilizing non-eccentric devices.

BACKGROUND OF THE INVENTION

Engines provide a generally effective method of converting chemical energy into mechanical energy; they may turn fossil fuels into power that can drive the wheels of an automobile or the propeller of a boat. There are two general types of engines: piston engines and turbine engines. Piston engines are very common and have been adapted to numerous tasks. They provide relatively high amounts of torque or drive power, while being of a medium weight. Piston engines have numerous drawbacks including having many moving parts, having poor fuel efficiency, and being the root cause of significant amounts of pollution, while also being costly to assemble. Piston engines utilize a to-and-fro motion of the piston to generate torque. Consequently, piston engines are termed eccentric. Their eccentric nature is the cause of many of their inefficiencies.

Turbine engines are also common, particularly in aircraft. Known turbine engines operate by forcing a fluid (gas or liquid) through the engine, thus turning the fan-blades of the turbine. Known turbines may be characterized as momentum turbines because they operate by transferring the momentum of the fluid to the fan blades of the turbine. The hallmark of a momentum turbine is that if the rotation of the fan blades is prevented, the flowing fluid will continue to flow through the engine around the fan blades. Essentially no back pressure is created through the engine.

Known turbine engines have desirably high power to weight ratios, but have poor fuel efficiency, are difficult to cool and have short operational life spans given the extreme operating conditions. Also, turbine engines are generally unsuitable for use in ground vehicles because of the complex transmission required to translate the high speed of the turbine into the low speed of the vehicle wheels. Because turbine engines utilize pure rotary motion of the fan blades to generate torque, turbine engines are termed non-eccentric engines.

A Wankel engine combines some of the advantages of piston engines and turbine engines but sacrifices fuel efficiency and torque, which are both quite poor. Wankel engines use a single rotor and an eccentric shaft that wobbles the rotor.

Known compressors/pumps include gear pumps and lobe pumps. Although they utilize rotors and rotary motion, these types of compressors/pumps have several drawbacks. Effectively, gear/lobe pumps accomplish pumping by drawing fluid from one reservoir and transporting it to another reservoir. They may be characterized as one-way transporting valves. At no point do the rotors cooperate to compress or pump the fluid. In addition, they are inefficient and have relatively poor rates of pumping/compression. Also, gear and lobe pumps cannot be adapted for use as an engine.

Known apparatuses have not been able to harness the energy of gravity in combination with geothermal energy to generate electricity and/or heat. Or Consequently, the inventor has recognized the need for improved compressors, pumps and engines.

SUMMARY OF THE INVENTION

The present invention is an apparatus that includes a chamber rotor with a chamber and an extension rotor with an extension. The rotors are housed in a rotor case. A pressure cavity is at least transiently formed by the extension rotor and the chamber rotor. The present invention also includes a compressor that includes a chamber rotor with a chamber and an extension rotor with an extension where the extension is adapted to be received in the chamber when the rotors are synchronously rotated. The compressor also includes a power input shaft attached to the extension rotor and a gear assembly attached to the rotors that is adapted to insure the synchronous rotation of the rotors. A rotor case houses the rotors and has an intake port and an exhaust port. The present invention also includes an engine that is similar to the compressor and includes a spark plug. Methods of compressing, pumping and generating electricity and mechanical power are also part of the present invention.

The present is also a system having a heat pump with an expander in a fluid circuit. The system utilizes a heat transfer fluid that is cycled through the fluid circuit from the expander to a means for compressing the heat transfer fluid and back to the expander again. The fluid circuit may be any length and is preferably at least 2 m in length. The expander is located near the lowest gravitational potential energy position in the fluid circuit. In one embodiment, the heat pump also comprises a condenser. In another embodiment, the heat pump is a Stirling engine.

DETAILED DESCRIPTION

The present invention is a non-eccentric, internal combustion engine that can be used in place of traditional engines including piston engines, turbine engines, and Wankel engines. Furthermore, the present invention is also a high efficiency compressor that may be used in place of traditional compressors. The present invention may also be used as a pump.

Figure 1:
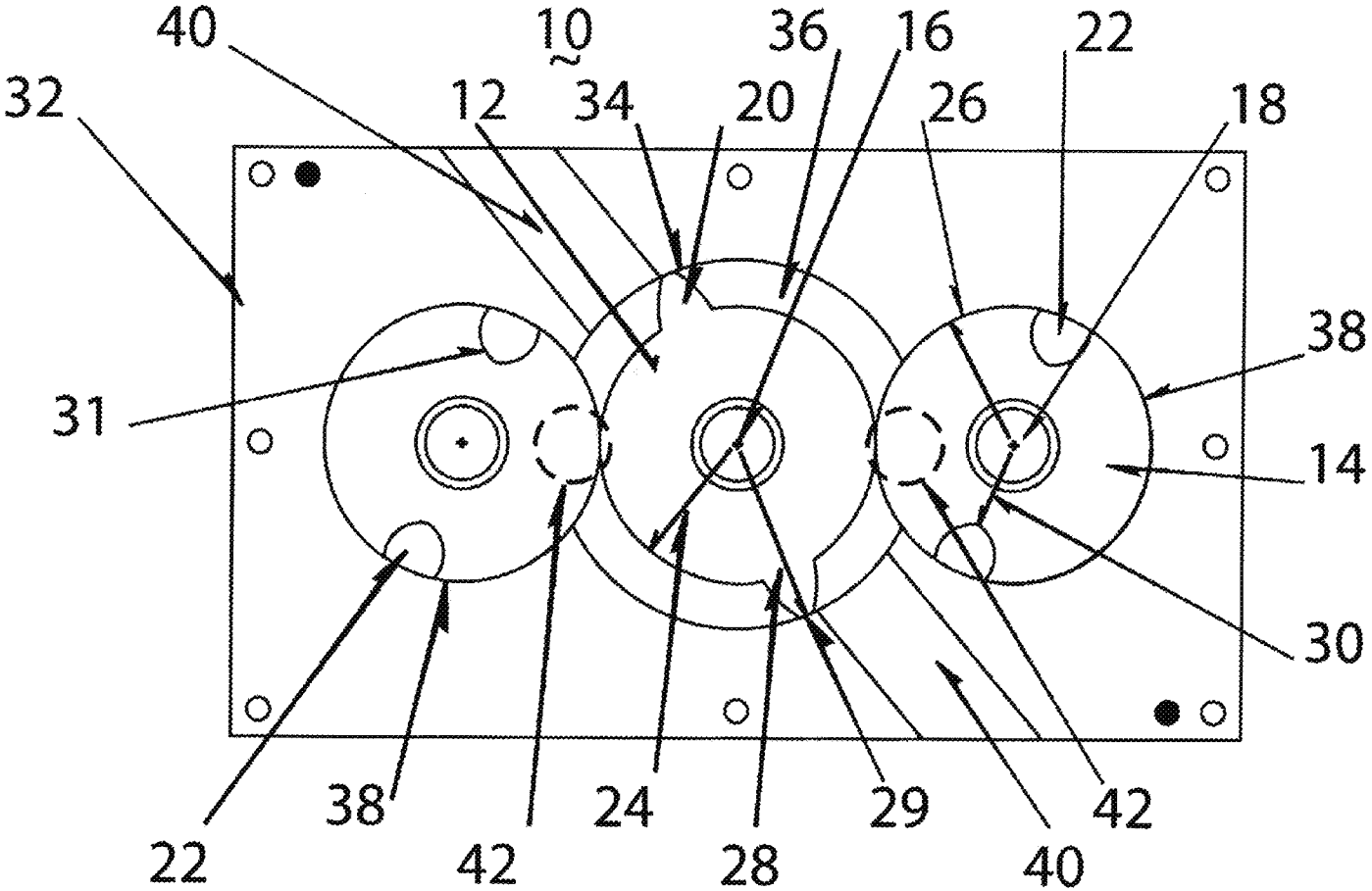
FIG. 1 shows a cross-section of a device according to the present invention.

As seen in cross-section in FIG. 1, the non-eccentric device 10 of the present invention includes at least a pair of rotors 12, 14 that each has an axis of rotation 16, 18 at the center of mass of the rotor. The first rotor 12 includes at least one extension 20, and is termed the extension rotor. The extension 20 is generally a mound-shaped protrusion on the edge of the rotor. The positioning of the extension(s) on the circumference of the rotor is selected so that the rotor is balanced to provide pure rotary motion. For example, with two extensions, the extensions are located 180° from each other, while with three extensions, the extension are located 120° from each other. With a single extension, the axis of rotation is preferably placed to achieve pure rotary motion. The extension rotor of the present invention is non-eccentric and thus more like the fan blade of a turbine engine then the piston of a piston engine or the rotor in the Wankel engine.

The second rotor 14 includes at least one chamber 22, and is termed the chamber rotor. The chamber 22 is generally an indentation into the edge of the rotor that is adapted to accept the extension. Like the extensions, the chambers are positioned on the circumference of the rotor is selected so that the rotor is balanced to provide pure rotary motion. Typically, the number of chambers will be equal to the number extensions, although this is not necessarily the case because the rotors may be sized so that a two-extension rotor could be used with a one-chamber rotor or so that a three-extension rotor could be used with a two-chamber rotor. Thus, the relative number of extensions and chambers is not critical so long as the rotors may be synchronously rotated and the extension(s) does not substantially interfere with the rotor rotation when the rotors are placed adjacent to each other.

The rotors each have a base radius 24, 26 that defines the size of the rotor. The distance between the respective axes of rotation 16, 18 is about the sum of the base radii. The extension rotor 12 has an extension radius 28 that defines the distance from the axis of rotation 16 to the extension apex 29. The length of the extension is the difference between the base radius 24 and the extension radius 28. Likewise, the chamber rotor 14 has a chamber radius 30 that defines the distance to the chamber nadir 31 from the axis of rotation 18. The depth of the chamber is the difference between the base radius 26 and the chamber radius 30. The extension length and chamber depth may be equal in the compressor and pump aspects. In the engine aspect, this is not necessarily so. While typically circular in shape, rotor shape is not so limited and may have any shape, including shapes that are not regular polygons.

The shape of the extension and the chamber are complementary to each other such that during rotation of the rotors, the extension sweeps through the chamber without catching on the chamber rotor or otherwise interfering with the rotation of the rotors. The extension may range in shape from an arc without discontinuities to a pair of arcs that meet at a discontinuity to a pair of arcs separated by an intermediate surface. Other shapes may also be suitable such as fins or vanes. An extension with a single discontinuity is preferred for the compressor aspect, while an extension with an intermediate surface is preferred for the engine aspect. The motion of the extension apex generally defines the shape of the chamber.

A gear assembly and/or shaft assembly (shown in FIGS. 3B-C) at each axis of rotation ensures the synchronous rotation of the extension rotor and the chamber rotor so that the extension moves unobstructed into and out of the chamber. The shaft assembly also provides a method of injecting or extracting power into or out of the system.

In addition, the present invention includes a rotor case 32 that houses the rotors and generally seals the rotors from ambient conditions. The rotor case typically includes several pieces to ease construction and assembly of the present invention, although this is not necessarily the case. The rotor case includes at least one interior cut-out in which the rotors reside. The cut-out defines one lobe for each rotor and is sized according to the particular rotor located in that lobe. For example, as seen in FIG. 1, the lobe 34 for the extension rotor must be able to accommodate the extension radius of the rotor. In this arrangement, a pressure cavity 36 is created between the extension rotor, the chamber rotor, and the rotor case (not including the roof and floor of the rotor case). The volume of the pressure cavity depends, inter alia, on the thickness of the rotor and the extension length. The lobe 38 associated with the chamber rotor need only accommodate the base radius of the chamber rotor.

The rotor case may include one or more intake and/or exhaust ports 40, 42, to facilitate operation of the system. The ports preferably have a flow path that is perpendicular or parallel to the axis of rotation of the rotors, although this is not necessarily the case.

The components of the present invention may be made out of any suitable material including metals, plastics, composites, and combinations thereof. Preferred materials are light weight, yet have the strength to withstand the operating conditions, i.e., pressure and temperature, of the present invention. Preferred materials are not brittle. Preferred metals include aluminum and/or steel, although other alloys are also suitable. Suitable plastics include those known to be useful in components of piston or turbine engines. Although typically made of a unitary construction, the components may have any suitable construction such as multiple layers bonded together or shells over a ballast. Indeed, for metal components any suitable construction method may be used including molding, with machining being preferred. Likewise plastic components may be made by any suitable method including injection molding and machining.

One embodiment of the compressor aspect of the present invention is shown in cross-section in FIG. 2A-F. The compressor 100 includes one extension rotor 102 and two chamber rotors 104, 106. In this particular embodiment, the extension rotor 102 has two extensions 108, 110, while the chamber rotors 104, 106 each have two chambers 112, 114. The rotor case 116 includes two intake ports 118 and two exhaust ports 120. A pressure cavity 122 exists between the rotor case 116, the base radius of the extension rotor 102 and the base radius of the chamber rotor 104 or 106. Arrows 124, 126 show the direction of rotation of the rotors. A power input shaft is connected to the extension rotor to drive the rotor, while a gear assembly on the shaft ensures that the chamber rotors are also driven and that the rotors have synchronous rotation.

Figure 2B:
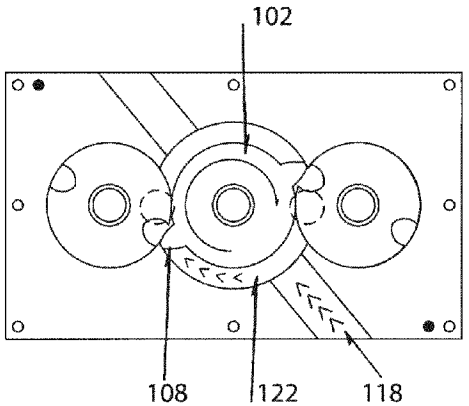
FIGS. 2A-2F show cross-sections of a compressor according to the present invention, including illustrating several different stages in the operation of the compressor.
Figure 2D:
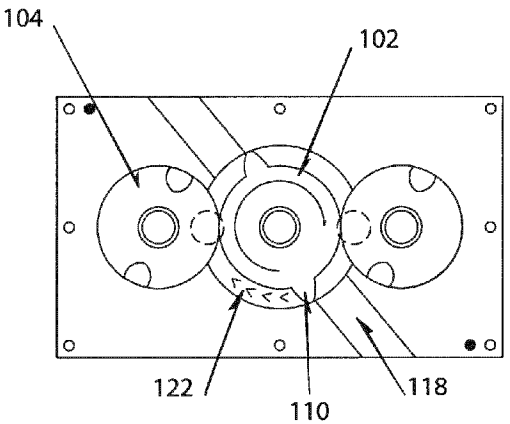
Figure 2A:
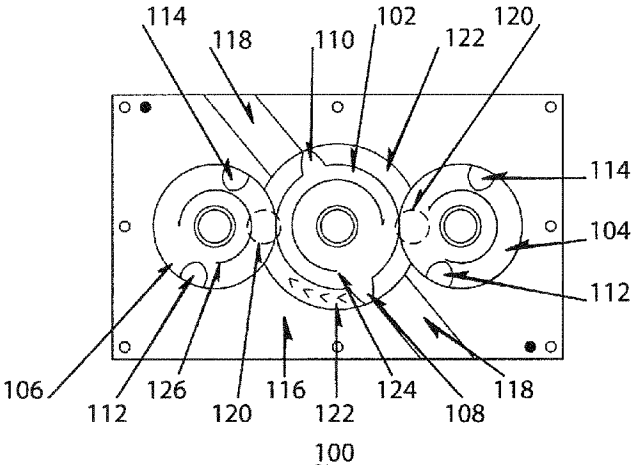
Figure 2C:
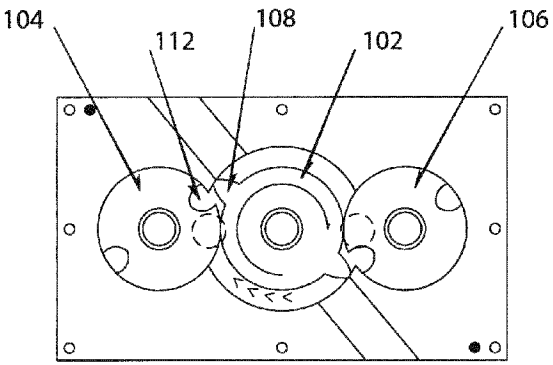
Figure 2F:
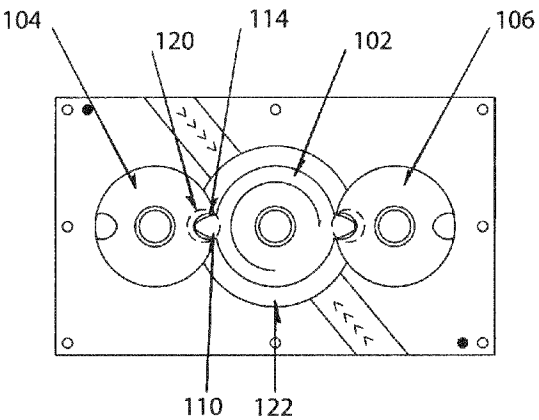
Figure 2E:
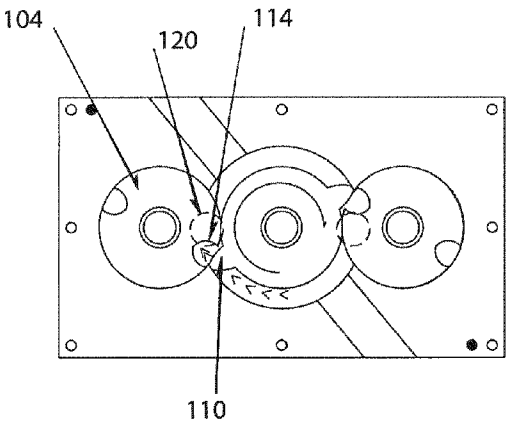

The compressor of the present embodiment may be divided into two halves where both have identical operation. Each half includes one chamber rotor, one intake port and one exhaust port, while the extension rotor is shared between the halves. Consequently, only the operation of one half of the compressor needs to be discussed in detail. As seen in FIG. 2B, as the shaft turns the extension rotor 102, the first extension 108 sweeps out a volume in the pressure cavity 122, creating a vacuum on the backside of the first extension 108. A gas (shown as chevrons) is drawn into this vacuum through the intake port 118. Due to the synchronous rotation of the extension rotor 102 and the chamber rotors 104, 106, the first extension 108 will be accepted in and sweep through the first chamber 112 (FIG. 2C). After this, the second extension 110 will close the intake port 118 (FIG. 2D) and start the compression of the gas that was drawn up in the pressure cavity by the vacuum created on the sweep of the first extension. Because of a seal between the chamber rotor 104 and extension rotor 102, the gas will not be able to escape and will thus be compressed on the front side of the second extension 110 as it sweeps out a volume in the pressure cavity 122. Just before the second extension 110 enters the second chamber 114, the gas is compressed down to a small pressure cavity that is made up of only the extension rotor 102 and the chamber rotor 104. The gas is enclosed by the walls of the chamber and the extension (as shown in FIG. 2E). As the second extension 110 sweeps through the second chamber 114, the exhaust port 120 is opened by the movement of the chamber rotor 104. Effectively, the chamber rotor 104, acts as a rotary valve to open and close the exhaust port. With the exhaust port 120 open, the compressed gas is forced out of the compressor, as can be seen in FIG. 2F, where the extension rotor 102 is top-dead-center. This series of events is repeated for each half rotation of the extension rotor 102. As can be seen, the gas in the pressure cavity 122 is compressed to roughly the volume of the chamber 112 or 114. Since the chamber is significantly smaller than the cavity, the present invention can achieve significant rates of compression. Because the rotors have pure rotary motion, they may be run at high rpms without damaging the compressor or its components, thus achieving high compression rates.

To achieve maximal compression, the rotors, extensions, chambers and rotor case are sized and shaped so that seals are created wherever moving components contact or where a moving component contacts a stationary component. For example, the extension sealingly slides along the rotor case and the chamber wall during rotation of the rotors, while the extension rotor seals against the chamber rotor. Alternately, the rotors and rotor case need not be in contact with each other to provide for adequate sealing. Furthermore, the rotor case may include components that help seal the rotors from the ambient conditions.

A variety of valves and reservoirs may be used to increase the efficiency of the compressor. For example, a one-way valve located beyond the exhaust port may help prevent backflow. Furthermore, reservoirs may be used to as source of gas to be compressed or as storage for compressed gas.

In addition to gases, this device may operate on other fluids. For example, this device may pump liquids or gas/liquid mixtures. The location of the intake port may be adjusted to minimize the compression of the liquid while maximizing the volume of liquid being pumped. For example, the intake port may be moved closer to the exhaust port in the rotor case.

In an alternate mode of operation, the compressor embodiment of the present invention operates to efficiently produce heat, electricity and mechanical energy. By switching the intake port with the exhaust port and reversing the directions of rotation of the rotors, the energy in a high pressure intake gas can be converted to heat, electricity or mechanical energy. In essence, the operation of the compressor described above with respect to FIGS. 2A-F is run in reverse. In this alternate mode of operation, port 120 is an intake port and port 118 is an exhaust port. A high pressure reservoir may be used to introduce gases under pressure at the now intake port 120 into a pressure cavity that is made up of the chamber rotor 104 or 106 and the extension rotor 102. The high pressure gases push on the extensions 108, 110 causing the extension rotor 102 to rotate, which can be used to generate electricity or tapped as a source of mechanical energy. As the extension rotor 102 rotates, the pressure cavity increases in volume (it is now formed by the extension rotor, chamber rotor and the rotor case) causing the high pressure gases to expand and give off heat. Depending on the type of gas, the gas may also condense to a liquid. In any event, continued rotation of the extension rotor 102 opens the now exhaust port 118, allowing the gases/liquids to exit to a collection reservoir. The collection reservoir may be fluidly connected to the high pressure reservoir to recycle the collected gases/liquids. The radiated heat may be used to heat the high pressure reservoir, the collection reservoir, some other reservoir, or some other space. In one embodiment of this alternate mode of operation, the high pressure gas utilized is water vapor that is preferably created through the use of solar energy. The solar energy is thus efficiently turned into heat, electricity and/or mechanical energy.

Figure 3A:
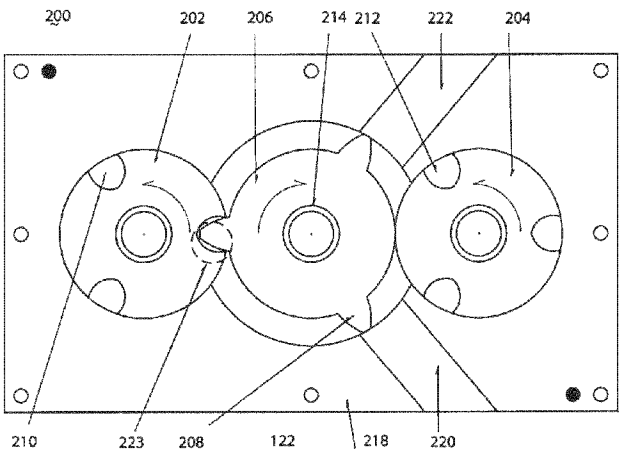
FIGS. 3A-3C show cross-sectional and isometric views of an engine according to the present invention.
Figure 3B:
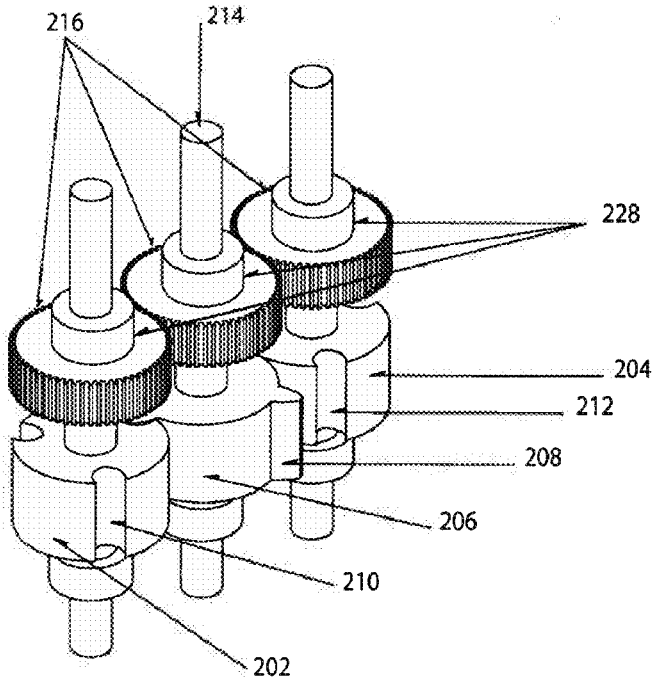
Figure 3C:
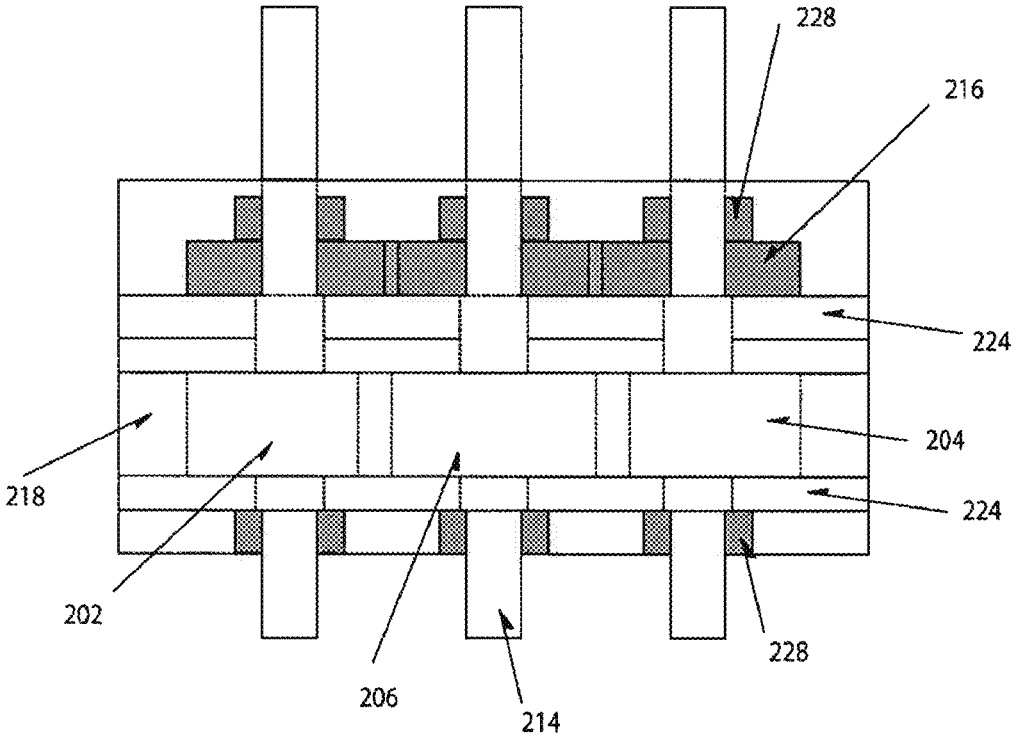

One embodiment of the engine aspect of the present invention is shown in FIGS. 3A-C. In this embodiment, the engine 200 includes three rotors: two chamber rotors and one extension rotor. The first chamber rotor is called the combustion rotor 202, while the second chamber rotor is called the isolation rotor 204. The extension rotor is called the power rotor 206. In this particular embodiment, the power rotor 206 has three extensions 208, which correspond to the three chambers 210 of the combustion rotor 202 or the three chambers 212 of the isolation rotor 204. A power output shaft 214 is connected to the power rotor 206. A gear assembly 216, as seen in FIGS. 3B-C, synchronizes the rotation of the three rotors. A rotor case 218 also includes an intake port 220 and an exhaust port 222. A spark or glow plug 223 is located near the combustion rotor 202. As best seen in FIG. 3C, the rotor case 218 may include a variety of plates 224, gearboxes 226, and bearings 228 to facilitate operation of the engine. In addition, a variety of seals may be located on the plates to help seal the rotors from the ambient conditions.

In the engine, like the compressor, it is preferable that the rotors are sized and shaped so that seals are created wherever the rotors touch each other. Furthermore, the extension sealingly slides along the rotor case during rotation of the rotors. Alternately, the rotors and rotor case need not be in contact with each other to provide for adequate sealing for operation.

Unlike the compressor, the extensions are sized and shaped so that they do not touch the chamber wall when the extension rotor is top-dead-center. This may be accomplished by providing a slightly shortened extension or by providing a plateau extension where the apex of the extension has been flattened. Alternately, this may be accomplished by a providing a slightly deepened chamber or by providing a chamber wall where the shape has been adjusted to assure that the extension apex does not contact the chamber wall when then extension rotor is top-dead-center.

Figure 4A:
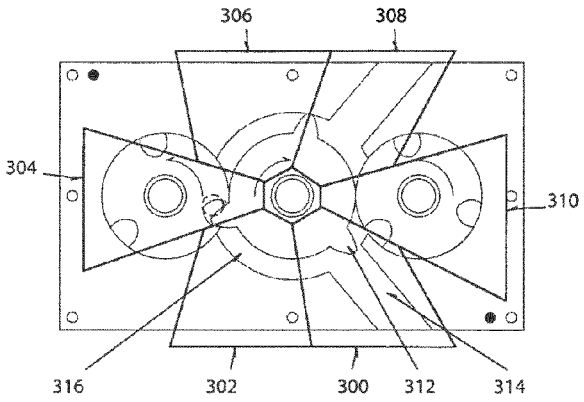
FIGS. 4A-C show a cross-section of an engine according to the present invention with operational zones demarcated.
Figure 4B:
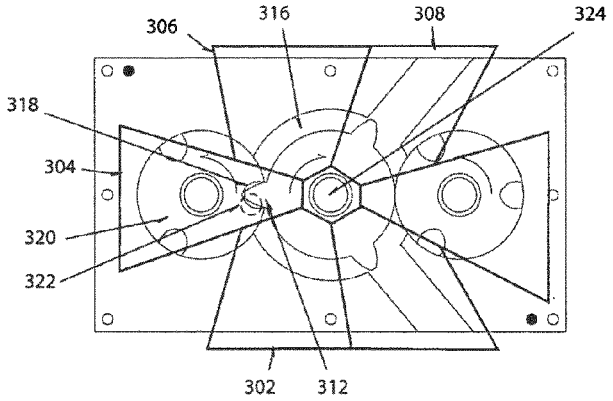
Figure 4C:
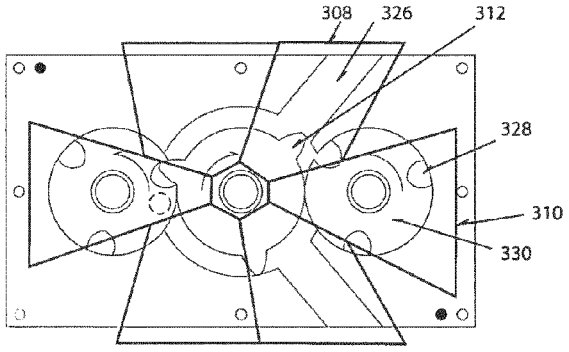

FIGS. 4A-C show a general overview of the operation of this embodiment of the engine aspect of this invention. Although no strict boundaries exist, the engine generally has six zones, which are: intake 300, compression 302, combustion 304, power 306, exhaust 308 and isolation 310. In the intake zone 300, the extensions 312 sweep through to alternately close then open the intake port 314 to the introduce intake gases, i.e., air/fuel mixture. In the compression zone 302, the extensions 312 sweep through the pressure cavity 316 to compress the intake gases. In the combustion zone 304, the extensions 312 cooperate with the chambers 318 of combustion rotor 320 to provide a pressure cavity with compressed intake gases that are ignited by a spark plug 322 to create the propelling combustion gases. In the power zone 306, the ignited combustion gases expand in the pressure cavity, pushing on the extension 312 and providing power to the power shaft 324 of the engine. In the exhaust zone 308, the extensions 312 sweep through to alternately open and close the exhaust port 326 and expel exhaust gases. In the isolation zone 310, the extensions 312 cooperate with the chambers 328 of the isolation rotor 330 to prevent exhaust gases from mixing with the intake gases.

Figure 5B:
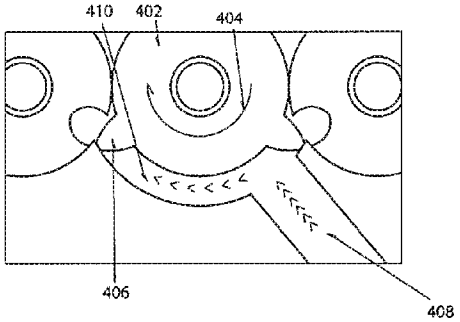
FIGS. 5A-F show cross-sections of an engine according to the present invention, including illustrating several different stages in the operation of the engine.
Figure 5D:
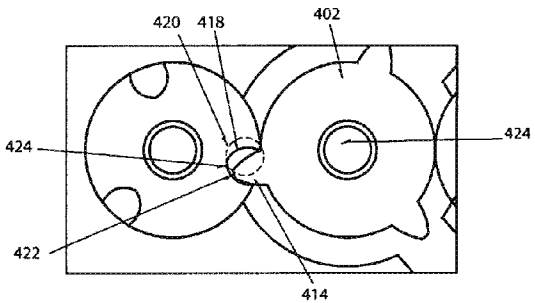
Figure 5A:
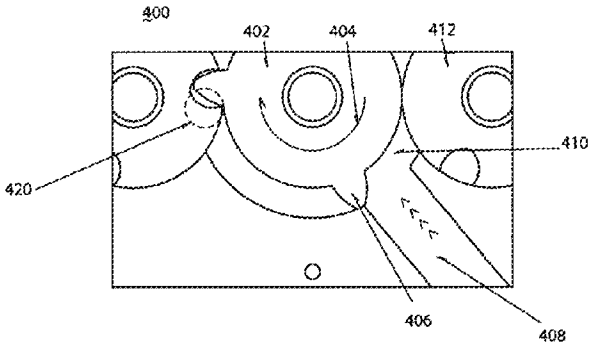
Figure 5C:
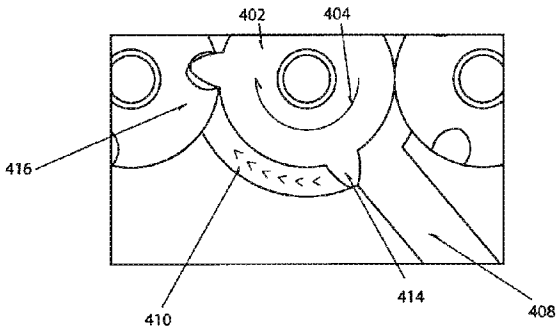
Figure 5F:
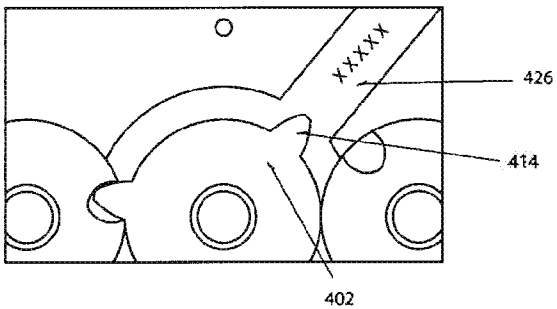
Figure 5E:
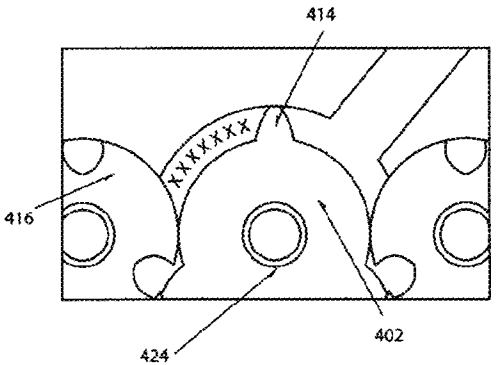

With reference to FIGS. 5A-G, a more detailed description of the operation of the engine is provided. As seen in FIG. 5A, in the engine 400, as the power rotor 402 rotates forward in the direction of the arrow 404, the first extension 406 opens the intake port 408 to allow the intake gases (shown as chevrons) into the cavity 410. The intake gases are prevented from back flowing by the seal between the power rotor 402 and the isolation rotor 412. As the first extension 406 continues to rotate forward, as seen in FIG. 5B, it creates a vacuum on its backside and draws the intake gases into the cavity 410 from intake port 408. As seen in FIG. 5C, further rotation of the power rotor 402 causes the second extension 414 to close the intake port 408 and seal the cavity 410. Continued rotation causes the second extension 414 to compress the intake gases in the cavity 410 against the combustion rotor 416 and the rotor case. The seal between the power rotor 402 and the combustion rotor 416 prevents the compressed intake gases from escaping. As seen in FIG. 5D, the intake gases move into the chamber 418 in front of the second extension 414 as it begins to sweep through the chamber 418. A spark plug 420 ignites the compressed intake gases just before the power rotor 402 reaches top-dead-center. Because the extension apex 422 is slightly spaced from the chamber nadir 423, the extension apex 422 does not contact the chamber wall. Consequently, the expanding combustion gases move from the front side of the second extension 414 to the backside, pushing on the backside of the second extension and transfer power to the power shaft 424. As seen in FIG. 5E, the combustion gases (shown as crosses) are prevented from back flowing by the seal between the power rotor 402 and the combustion rotor 416 and transfer power to the power shaft 424. As seen in FIG. 5F, continued rotation opens the exhaust port 426 and allows the combustion gases to vent without the need for valves or other mechanical devices. Indeed, the next extension effectively forces the majority of the exhaust gases out through the exhaust port 426 as it sweeps through. As seen in FIG. 5G, any remaining exhaust gases are effectively isolated from the intake zone. Similar to as discussed above with respect to the combustion zone, the extension apex 428 does not contact the valve rotor 428 and forces any remaining exhaust gases from front side of the extension 414 to the backside of the extension. As the extension 414 leaves the chamber 430, it seals the chamber from the intake zone, such that any remaining exhaust gases are trapped in the chamber. This completes one cycle of the engine and is roughly equivalent to a two or four-cycle engine. The process starts again with the intake of gases at intake port 408.

Figure 6:
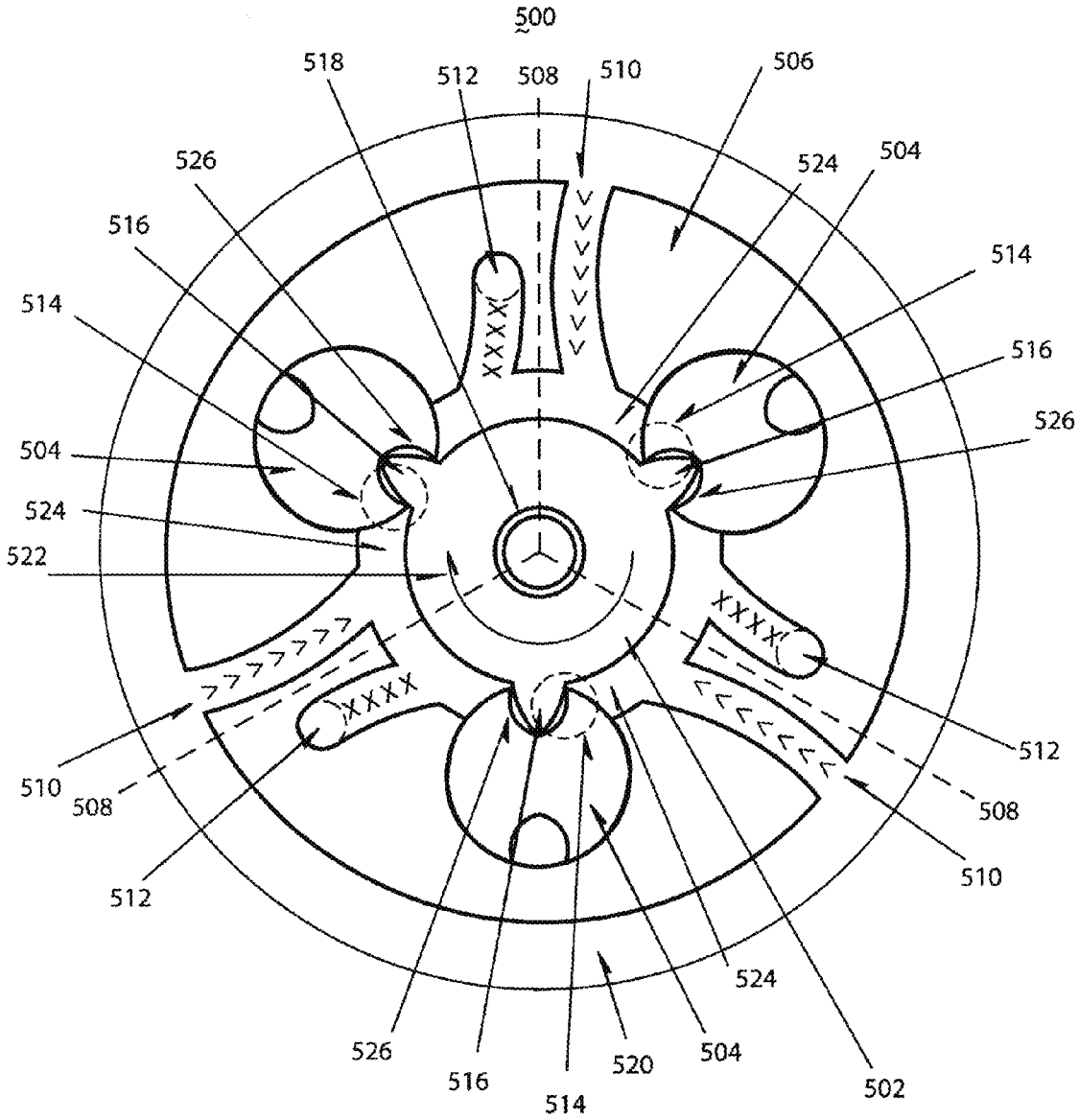
FIG. 6 shows a cross-section of another embodiment of an engine according to the present invention.

In a second embodiment of the engine aspect of the present invention, a single power rotor may be associated with more than two chamber rotors. As seen in FIG. 6, the engine 500 has a power rotor 502 associated with three combustion rotors 504 located in a rotor case 506. As discussed below, the isolation rotor is not used in this embodiment. The engine is divided into three identical operational zones, as roughly shown by the dotted lines 508. Each zone has a chamber rotor 504, an intake port 510, an exhaust port 512 and a spark plug 514. The power rotor 502 has three extensions 516 and a power output shaft 518. The intake port 510 is generally perpendicular to the axis of rotation of the power rotor. The exhaust port 512 has a portion that perpendicular and a portion parallel to the axis of rotation.

As discussed in more detail below, the engine 500 may also includes a pressurization ring 520 to evenly distribute pressurized intake gases around the rotor case 506. Other structures in the engine may be used to deliver the pressurized intake gases. The intake gases may be pressurized by any suitable device such as a supercharger, a turbocharger, a root blower and/or the compressor aspect of the present invention.

The operation of this embodiment is similar to the first embodiment of the engine aspect, but with some significant differences. As with the first embodiment, this engine has the same six zones. Rather then being spread across the entire perimeter of the power rotor, in the present embodiment, the six zones are roughly spread across only a third of the perimeter of the power rotor. This effectively increases the power density of the engine by replacing three power rotors, three combustion rotors and three valve rotors with one power rotor and three combustion rotors.

In place of the isolation rotor, pressurized intake gases are used to keep the intake gases separate from the exhaust gases. The pressurized intake gases effectively create barrier between each operational zone (roughly located where dotted line 508 is located). The pressurized barrier prevents exhaust gases from mixing with the intake gases, eliminating the need for the isolation rotor. The pressurized gases also turbo charge the engine.

Pressurized intake gases (shown as chevrons) are introduced at the intake ports 510. The curved intake ports direct the intake gases in the direction of rotation of the power rotor 502 (shown by arrow 522), thus creating the barrier between the intake and exhaust gases.

As in the other embodiments and aspects of this invention, the extension 516 compresses the intake gases as it sweeps them from the cavity 524 into the chamber 526 of the combustion rotor 504. Just before the power rotor 502 reaches top-dead-center, the spark plug 514 ignites the intake gases. The combustion gases push the extension 516, transferring power to the shaft 518. The exhaust gases (shown by crosses) are vented out the exhaust port 512. As mentioned above, the pressurized barrier of intake gases prevents the exhaust gases from mixing with the intake gases.

The spark plugs may be fired in sequence, but preferably the spark plugs are fired simultaneously, effectively tripling the power produced by the engine. Indeed, an additional power multiplier could be obtained through the use of additional extensions on the power rotor in combination with additional combustion rotors.

Figure 7A:
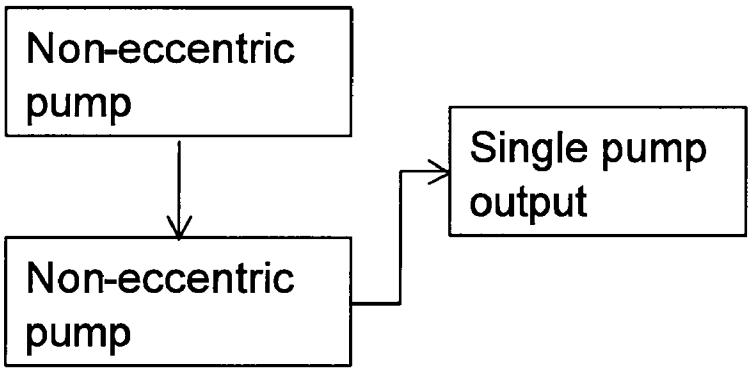
FIG. 7A-D show schematically two cooperatively connected non-eccentric devices.
Figure 7B:
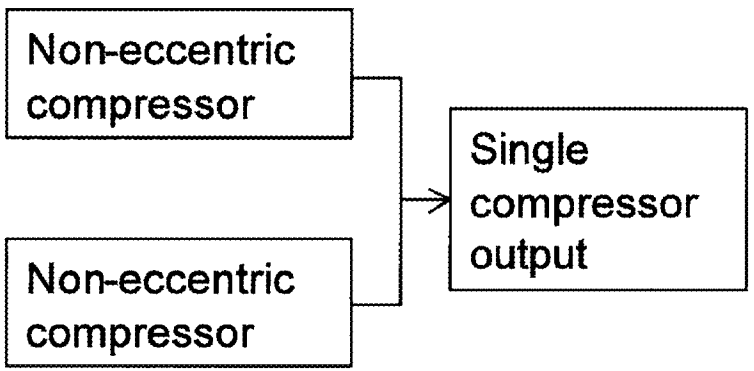
Figure 7C:
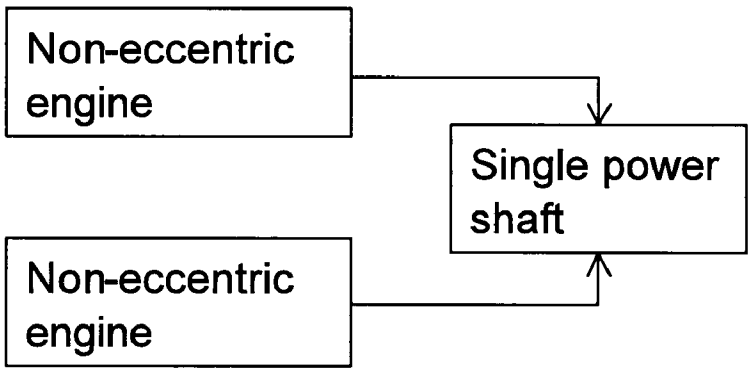
Figure 7D:
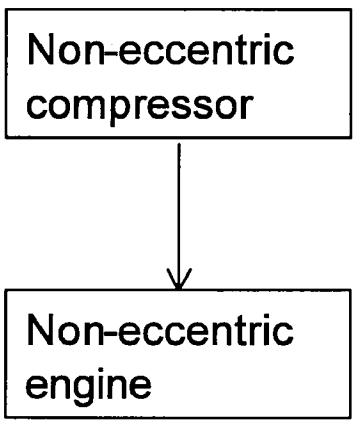

Also contemplated is combinatorial use of the pump, compressor and engine aspects of this invention. For example, several compressors may be serially connected such that the exhaust port of one is connected to intake port of the next, thus allowing gases to be compressed several times over. Also, several pumps acting on liquids can be serially connected to effectively act as "repeaters" to maintain a liquid flowing at a particular speed or under a particular pressure over a distance, as shown in FIG. 7A. Also, compressors could be used in parallel to greatly increase the rate at which compression/pumping could be accomplished, as shown in FIG. 7B. Likewise, several engines could be used in combination to generate a power for a single transmission, vehicle and/or machine, as shown in FIG. 7C. Furthermore, engines and compressors/pumps could be used in combination. For example, the power output shaft of the engine could be used to drive the power input shaft of the compressor. Also, the compressor could provide compressed intake gases to the engine or a pump could provide coolant fluid for the engine, as shown in FIG. 7D.

The present invention differs from known compressors and pumps in its operation. As discussed above, the rotors utilized in the present invention work together, i.e., they cooperate, to compress or to pump the fluid. Other components may also be part of the cooperative compression or pumping process, but unlike other devices, the rotors, at some point in their rotation, cooperate with each other to compress or pump the fluid being acted upon.

The present invention differs from known engines in several significant ways. Most importantly, the present engine is a pure non-eccentric engine, which significantly distinguishes it from a majority of known engines including piston and Wankel engines. As for turbine engines, which are also purely non-eccentric, the present invention is not a momentum turbine engine, but rather may be characterized as a pressure turbine engine. As discussed above, in known turbine engines, when the fan blades are prevented from rotating, the fluid merely continues to flow through the engine and no backpressure is created. In the present invention, if the power rotor is prevented from rotating, the intake gases cannot continue to flow through the engine and around the power rotor. This causes the intake gases to stack up and create backpressure. Hence, the characterization of the present engine as a pressure turbine engine as opposed to a momentum turbine engine. Likewise, the compressor of the present invention is also a pressure turbine device.

Given the significant differences between the present invention and known engines, easy comparison is not possible. A comparison among different engine types (turbine versus piston) is difficult because most engines are usually only compared within an engine type, i.e., one piston engine is compared to another piston engine. However, some comparison can be undertaken using some general properties of engines such as horsepower, fuel efficiency, emissions, weight, torque and power density. Tables I & II show comparisons of several engines including an aircraft gas turbine engine, three marine piston engines and four theoretical engines according to the present invention (called Pressure Turbine Engines or PTEs). All the PTE would be built according to the embodiment shown in FIGS. 3-5. All weight calculations of the PTEs are based on using aluminum as the predominant material for the engine. The calculation of the weight of PTE II and PTE III would include accessories such as a gear train or a transmission. Calculations of horsepower in PTE III and PTE IV include the assumption that they would be turbocharged. While Table I compares physical characteristics, Table II compares operational characteristics. For known engine types, values for the attributes are drawn from published resources or calculated from published values. For the present inventive engines, the attribute values are calculated based on theory or from prototypes.

TABLE I

| Type | Weight (lb) | Displacement ($in^3$) | Size ($in^3$) | Parts | Emissions |
|---|---|---|---|---|---|
| Aircraft Gas Turbine | 210 | — | ~20664 | ~500 | High |
| Marine Diesel | 2500 | 641 | ~122400 | ~750 | Low |
| Marine Diesel* | 900 | 257 | ~30576 | ~750 | Low |
| Marine Gas | 940 | 350 | ~28380 | ~750 | Low |
| PTE I | 230 | 54 | ~3388 | ~12 | Very Low |
| PTE II | 300 | 54 | ~3388 | ~12 | Very Low |
| PTE III* | 350 | 54 | ~3388 | ~12 | Very Low |
| PTE IV* | 300 | 54 | ~3388 | ~12 | Very Low |

*These engines are turbocharged

From Table I it can be seen that the PTEs have several advantageous physical characteristics compared to known engines. For example, PTEs weigh slightly more than the gas turbine engine, but significantly less than the marine engines. With respect to displacement, the PTEs have a displacement that is several times smaller than the marine engines. The overall physical size of the PTEs is at least one order of magnitude smaller than the other engines, making the PTEs suitable for a larger number of applications. Also, several PTEs could be used in the space of one traditional engine. PTEs also have significantly fewer parts, which reduces costs of manufacturing assembly and maintenance, as well as dramatically increasing the reliability of the PTEs. While not wanting to be limited, it is believed that PTEs will be clean burning engines because of the long burn time possible in PTEs given that the pressure cavity lengthens during combustion. Given the proper air/fuel mixture, essentially complete combustion can occur in the cavity between spark plug and the exhaust port. The length of the burn path ensures an essentially complete burn.

TABLE II

| Type | HP | RPM | Fuel Efficiency (lb/hr-hp) | Torque | Power-Displacement ($hp/in^3$) | Power Density (hp/lb) |
|---|---|---|---|---|---|---|
| Aircraft Gas Turbine | 380 | 30000 | 0.635 | 66 | — | 1.8 |
| Marine Diesel | 250 | 2000 | 0.374 | 670 | 0.37 | 0.10 |
| Marine Diesel* | 255 | 3600 | 0.42 | 372 | 0.99 | 0.28 |
| Marine Gas | 195 | 3500 | 0.35 | 337 | 0.56 | 0.21 |
| PTE I | 200 | 8000 | 0.35 | 130 | 4.6 | 0.86 |
| PTE II | 200 | 8000 | 0.35 | 130 | 4.6 | 0.67 |
| PTE III* | 400 | 16000 | 0.35 | 130 | 7.4 | 1.15 |
| PTE IV* | 400 | 16000 | 0.35 | 130 | 7.4 | 1.33 |

*These engines are turbocharged.

From Table II it can be seen that the PTEs have several advantageous operational characteristics compared to known engines. For example, despite their small weight, size and displacement, the PTEs have horsepower ratings that are higher than any other engine. The operational rpm (the speed at which the power rotor turns) of the PTEs is also significantly higher than the marine piston engines. The fuel efficiency of the PTEs is at least comparable to the known engines, if not slightly better than most of the known engines.

The output torque of the PTEs is not as high as the output of the marine engines, but is nonetheless sufficient for a large variety of uses. The PTEs separate themselves from known engines when the size and weight of the PTEs is factored into the horsepower rating. As can be seen with respect to power-displacement, the PTEs are at least 4.6 times better than the best marine engine, and at least 12 times better than the worst marine engine. The power density rating of the PTEs shows similar results with respect to the marine engines. The PTEs are far more power dense than the marine engines. With respect to the gas turbine engine, the PTEs are less power dense; however, the PTEs have other attributes that make them desirable in view of gas turbine engines including smaller size, significantly fewer parts, lower emissions and better fuel efficiency.

One other important characteristic of the present PTEs is that there is a linear relationship between rpm and output horsepower; as the rpm increases, so does horsepower with a theoretical maximum limited only by the rpm of the power rotor. The horsepower rating of known engines is usually given at a specific rpm, and there is a maximum horsepower after which increasing the rpm will not increase the horsepower. Like the compressor, the PTEs have a linear relationship between rpm and amount of intake gases pump. Since all intake gases will be combusted, there is a linear correlation between amount of intake gases and the horsepower. Consequently, there is also a linear relationship between rpm and horsepower; as the rpm of the power rotor increases, so does the output horsepower of the present PTEs.

In another embodiment, the present invention includes a system that comprises a heat pump having an expander and a compressor in a fluid circuit where a heat transfer fluid may be cycled through the circuit from the expander to the compressor and back again.

Figure 8:
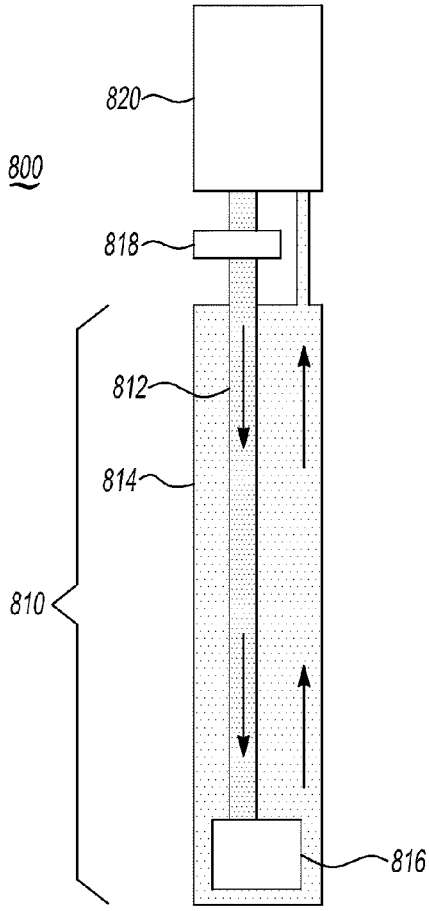
FIG. 8 shows schematically shows an embodiment utilizing gravity to compress the heat transfer fluid.

FIG. 8 illustrates a heat pump embodiment of the present invention. The heat pump 800 includes a fluid circuit 810 with concentric tubes 812, 814 (shown in cross-section) that are used with a pressure turbine as an expander 816 at the bottom of a well that is about 300 m in length, meaning the fluid circuit 810 is about 600 m in length. A mechanical compressor 818 is shown along with a heat sink 820.

In a mechanical compressor embodiment, the system utilizes a mechanical compressor such as a piston pump, a rotary pump, or a non-eccentric compressor, to provide compression to the heat transfer fluid. In a gravitational compressor embodiment, the system utilizes gravity to provide some if not all of the compression to the heat transfer fluid. In this way, a mechanical compressor can be eliminated or at least reduced in size. Stated alternatively, the heat pump may include a means for compressing the heat transfer fluid. Exemplary means for compressing include gravity, one or more piston pumps, one or more rotary pumps, one or more non-eccentric pressure turbines or combinations thereof.

The components of the heat pump may be entirely underground, partially underground or entirely above ground. Heat pumps that utilize gravity are preferably at least partially underground and may rely on gravity and geothermal energy while heat pumps above ground may rely on gravity alone or on mechanical compressors, as discussed below.

The expander may be any device that generally provides unidirectional flow of a fluid and has an intake and an exhaust. For example, an expansion valve, such as the type used in an air conditioning or refrigeration system, would be a suitable expander. Likewise, a piston pump or a turbine would also be suitable. Preferably, the expander is a pressure turbine. A pressure turbine is any rotary device that, when prevented from rotating, provides back pressure on the fluid. Preferably, the pressure turbine is a non-eccentric device as discussed above. As the name suggests, the expander has a high pressure side and a low pressure side.

The fluid circuit comprises tubing of any shape that connects the exhaust (i.e. low pressure) side of the expander to the intake (i.e. high pressure) side of the expander. In the gravitational compressor embodiment, the fluid circuit is at least 2 m in length and preferably 1, 2, 3, 4 or more orders of magnitude longer in length; i.e. 20, 200, 2,000, 20,000 m or more in length. In addition, the fluid circuit may be 10, 100, 1000, 10,000 m or more. As well, the fluid circuit may be discrete lengths between the specific lengths mentioned. The length of the fluid circuit largely depends on the heat transfer fluid selected and the temperature milieu into which the fluid circuit is placed. For the mechanical compressor embodiment, the length of the fluid circuit is less important, especially if no gravity is utilized as part of the compression of the heat transfer fluid.

The fluid circuit is generally divided in half, with the half closer to the exhaust side of the expander termed the exit portion. On the other hand, the return portion is the half of the fluid circuit that is closer to the intake side of the expander.

While a closed loop system is preferred, an open loop system may also be used, especially in the gravitational compressor embodiment where water is used as a heat transfer fluid. For example, the use of sea water, lake water or river water is contemplated in an open loop system.

In the gravitational compressor embodiment, the expander is preferably positioned near, or at, the location in the fluid circuit that has the minimum gravitational potential energy; that is, at the bottom of the system or fluid circuit. The dividing line between the exit portion and the return portion will be near, or at, the location in the fluid circuit that has the maximum gravitational potential energy; that is, at the top of the system or fluid circuit. Underground refers to placement of the expander or other component at a location other than the Earth's surface. For example, the expander may be located underground such as at the bottom of a well or borehole. The deeper the placement of the expander, more gravitational energy that may be utilized by the system. A mechanical compressor is not necessary in this embodiment because the necessary compression is provided by gravity.

A temperature gradient is present within the fluid circuit, such that the heat transfer fluid in different portions of the fluid circuit has different temperatures. Preferably, the temperature gradient is an ambient temperature gradient; more preferably, the ambient temperature gradient is the result of differential geothermal heating of the fluid circuit. However, other forms of external heating may also be utilized to create the temperature gradient. For example, solar thermal heating of the heat transfer fluid, either directly or indirectly may also be utilized. For the mechanical compressor embodiment, a temperature gradient is preferable.

The temperature gradient is preferably between about 10° C. and about 100° C.; i.e. a 10° C. difference in temperature at one point in the fluid circuit and another point in the fluid circuit. For example, a temperature gradient of 100° C. between the top of the fluid circuit and the bottom of the fluid circuit. In one preferred embodiment, the temperature in the fluid circuit near the exhaust side of the expander is at least 50° C. In another embodiment, the temperature in the fluid circuit near the exhaust side of the expander is at least 100° C. In a third embodiment, the temperature in the fluid circuit near the exhaust side of the expander ranges from about 50° C. to about 600° C.

A pressure gradient is also present within the fluid circuit, such that the heat transfer fluid in different portions of the fluid circuit is exposed to different pressures. The pressure gradient will be such that the pressure is the lowest close to the expander in the exit portion of the fluid circuit (i.e. near the expander exhaust) and the highest close to the expander on the return portion of the fluid circuit (i.e. near the expander intake). The pressure gradient is between about 60 kPa and about 4500 kPa; i.e. a 60 kPa difference in pressure at one point in the fluid circuit and another point in the fluid circuit. In one preferred embodiment, the pressure in the fluid circuit near the expander exhaust is at least 64 kPa. In another embodiment, the pressure in the fluid circuit near the expander intake is at least 4500 kPa. The pressure gradient in the heat transfer fluid is at least partially created by gravity in the gravitational compressor embodiment. For example, the heat transfer fluid near the highest point of gravitational potential energy weights down/compresses the heat transfer fluid lower down on the gravitational potential energy scale.

The fluid circuit may include two or more generally parallel tubes with any variety of cross-sectional shapes. For example, an inner tube may be used within an outer tube, e.g. concentric tubes. Three parallel tubes may be used with one for the return portion and two for the exit portion, or vice versa. The three tubes may be arranged in a line, a triangle or in a cat-eye cross-section (that is, one tube forms the iris and the other tubes form the white of the eye). The fluid circuit may be made of any material that can withstand the temperatures and pressures present within the system. In addition, insulation may be used to isolate one or more of the portions of the fluid circuit from the surrounding environment or other portions of the fluid circuit. The fluid circuit may generally be at any angle away from vertical, however, the closer to vertical, the more preferred the embodiment. In the alternative, the fluid circuit may include two or more tubes that are not parallel and may be any combination of straight, branched, angled, spiral or other shapes. In another embodiment, a special arrangement of tubes within tubes is not necessary and all that is needed a single tube to connect the appropriate inlets and outlets of the components of the heat pump.

In gravitational compressor embodiment, the tubes of the fluid circuit are preferably located, partially or entirely underground, e.g. the tubes are drilled or otherwise placed in the ground. Such a placement permits the fluid circuit to take advantage of geothermal energy. In another embodiment, the tubes of the fluid circuit may be geologic formations, whether natural occurring or otherwise. For example, a naturally occurring deep well filled with water may serve as one portion (e.g. the return portion) of the fluid circuit while a tube sunk in the well may be the exit portion of the fluid circuit.

In one embodiment, the heat pump may also comprise a heat sink. In the gravitational compressor embodiment, the heat sink is preferably positioned at, or near, the location in the fluid circuit that has the maximum gravitational potential energy; i.e. the top, and thus separates the exit portion from the return portion of the fluid circuit. The heat sink would be used to reduce the temperature of the heat transfer fluid, thus permitting the heat sink to extract additional energy from the fluid. The heat pump may also comprise a vapor pump to help move vapor through the fluid circuit. A compressor may be used in combination or in place of the condenser. The compressor would provide an initial amount of energy, in the form of heat and pressure, to the fluid as the fluid begin to travel the return circuit. In the mechanical compressor embodiment, the heat sink dissipates heat from the fluid, reducing its temperature.

Suitable heat transfer fluids include any compound, composition or mixture that undergoes a phase change from a liquid to a vapor and back. The selected heat transfer fluid will depend on the temperature gradient and pressure gradient in the fluid circuit, so that the heat transfer fluid will under go a phase change at the current temperature and pressure conditions near the expander. Exemplary heat transfer fluids include refrigerants designated using the R system developed by Dupont (e.g. R-134a, R-290, R-410A, R-409A, R-502, etc.), as well as water, alcohols, ammonias, and combinations there.

FIG. 8 illustrates a gravitational compressor embodiment of the present invention using lower temperatures. Heat pump 800 includes a fluid circuit 810 with concentric tubes 812, 814 (shown in cross-section) that are used with a pressure turbine as an expander 816 at the bottom of a well that is about 300 m in length, meaning the fluid circuit 810 is about 600 m in length.

In operation of the gravity fed embodiment, gravity compresses the heat transfer fluid in tube 812, i.e. the return portion of the circuit, providing the pressure to drive the expander 816. The heat transfer fluid near the top of the fluid circuit compresses the heat transfer fluid near the bottom of the fluid circuit. At this depth, the ground temperature is about 37° C. Both the increased pressure and temperature add energy to heat transfer fluid. As the heat transfer fluid travels through the expander 816, the stored energy is converted to electrical energy by driving the expander, which turn drives a generator. The heat transfer fluid, now a vapor, cools as it expands in tube 814, i.e. the exit portion of the fluid circuit, and travels to the top of the well, where additional energy may be optionally removed by the heat sink 820, e.g. through the use of a heat exchanger or a thermoelectric device. This additional energy maybe used to provide electricity, hot water, heating or cooling. After the heat sink, the now liquid heat transfer fluid flows via gravity back into the return portion of the fluid circuit. In the alternative, an electrical generator may also located near the heat sink to extract energy from the heat transfer fluid as it flows back into the return portion of the fluid circuit. E.g. if the heat transfer fluid is water, then a simple turbine may be used to extract gravitational energy from the water as it flows in the return portion. Throughout the heat pump, thermoelectric devices may be used to extract electrical energy from the system.

A mechanical compressor 818, is optionally used to provide a pressure gradient in the return portion of the fluid circuit, e.g. in tube 812. The operation of the embodiment comprising a mechanical compressor is substantially the same as the gravity fed embodiment. However, the mechanical compressor embodiment has fewer restrictions on use. For example, geothermal heating is not required for its operation. In one optional embodiment, a compressor is located in the return of the fluid circuit. The compressor would be beneficial if there is no temperature gradient between the top and bottom of the fluid circuit. This situation would arise if geothermal energy is not being utilized by the system. Instead, the system would extract mostly gravitational energy. Another embodiment uses higher temperatures and a water-comprising heat transfer fluid. The operation is the same as in FIG. 8 with the temperature in the fluid circuit being higher. This embodiment would be suitable for use in a location that has a geothermal hot spot such that the ground temperature is more than about 100° C. Depending on the ground temperature at the bottom of the well, a vapor pump may be used to help steam rise to the top of the well. Also, water from the heat sink (e.g. a steam condenser) might be suitable for use as a source of deionized or potable water.

In another embodiment, a reservoir may be included in the fluid circuit; typically the return portion of the fluid circuit. The reservoir is fluidly connected but separated from the rest of the fluid circuit by a series of valves. The reservoir contains heat transfer fluid at an elevated pressure such that the heat transfer fluid remains a liquid. The elevated pressure in the reservoir preferably achieved through the use of solar thermal heating where solar energy is harnessed to heat and pressurize the heat transfer fluid in the reservoir. Heat transfer fluid from the reservoir may be injected into the return portion of the fluid circuit in order to maintain the amount of heat transfer fluid in the fluid circuit or to provide additional heat transfer fluid to the fluid circuit. In this manner, solar energy may be used in conjunction with geothermal and gravitational energy to provide heating and pressurization to the heat transfer fluid in the system.

In the mechanical compressor embodiment, a combination of non-eccentric devices may be used to create a Sterling engine. Previous Sterling engines have suffered from the inefficiencies associated with the use of a piston and crankshaft. Non-eccentric devices eliminate the need for the piston/crankshaft design and offer more efficient torque and power output. As discussed above, the non-eccentric devices of the present application are pressure turbines, meaning that they cause backpressure to build up when the rotors are prevented from turning. Likewise, the fluid in the system does not escape when the rotors are prevented from turning.

Figure 9:
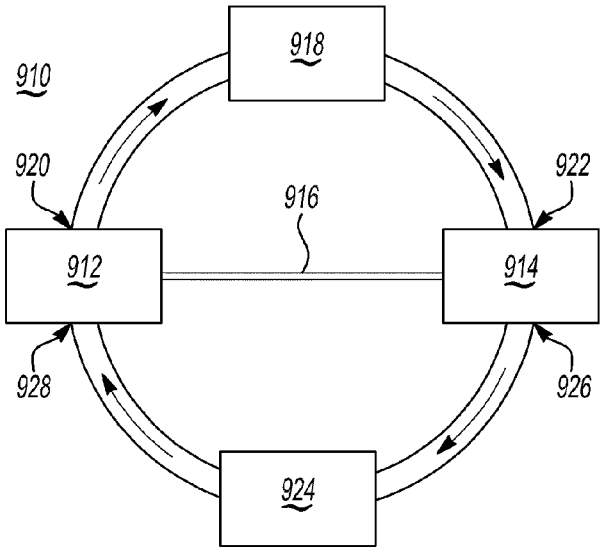
FIG. 9 shows schematically Sterling engine including non-eccentric devices.

As seen schematically in FIG. 9, the non-eccentric Stirling engine 910 comprises two non-eccentric devices with one device being a compressor 912 and one being an expander 914. The compressor and expander are mechanically connected by a shaft 916. Preferably, the compressor and the expander have the same number of rotors and extensions. A heat source 918 is fluidly connected to the exhaust port 920 of the compressor and the intake port 922 of the expander. A heat sink 924 is fluidly connected to the exhaust port 926 of the expander and the intake port 928 of the compressor.

In operation, the heat source produces high pressure, high temperature gas and releases it to the expander. The expander uses the high pressure, high temperature gas to generate torque and releases a low pressure, high temperature gas to the heat sink. The heat sink cools the high temperature gas and releases a low pressure, low temperature gas to the compressor. The compressor compresses the low pressure, low temperature gas and releases high pressure, low temperature gas to the heat source. This is the same thermodynamic cycle as in a piston type Stirling engine.

The shaft synchronizes the expander and compressor so that the compressor is out of phase with the expander. In the piston type Stirling engine, the compressor (i.e. the cold cylinder) is 90° out of phase with the expander (i.e. the host cylinder). For the non-eccentric Stirling engine with two extensions in the compressor and the expander, a similar situation is likely. Additionally, the phase will depend on the coefficient of friction of the heat transfer fluid. As the coefficient of friction increases and the fluid is harder to move, the distance the fluid has to travel between the expander and the compressor will influence the phase between the expander and the compressor. This may mean the phase will vary by ±5°, ±10°, ±15°, ±20°, ±25°, ±30°, ±35° or more from the original 90° degrees out of phase. For example, the compressor may be about 75° to about 105° out of phase with the expander. For non-eccentric Stirling engines with more extensions, the degree to which the compressor is out of phase with the expander will be the number of extensions will be 180° divided by the number of extensions. For three extensions, then, the compressor will be 60° out of phase with the compressor. As above, the phase will also depend on the coefficient of friction of the heat transfer fluid and may result in the compressor being an additional ±15° out of phase with the expander. Heat energy that otherwise may to go to waste may be converted to electricity by thermoelectric devices.

Throughout the specification 'top' and 'bottom' are used to describe relative positions, with 'top' generally referring to a location that has a higher gravitational potential energy then 'bottom.' It will be further appreciated that functions or structures of a plurality of components or steps may be combined into a single component or step, or the functions or structures of one-step or component may be split among plural steps or components. The present invention contemplates all of these combinations. Unless stated otherwise, dimensions and geometries of the various structures depicted herein are not intended to be restrictive of the invention, and other dimensions or geometries are possible. Plural structural components or steps can be provided by a single integrated structure or step. Alternatively, a single integrated structure or step might be divided into separate plural components or steps. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention. The present invention also encompasses intermediate and end products resulting from the practice of the methods herein. The use of "comprising" or "including" also contemplates embodiments that "consist essentially of" or "consist of" the recited feature.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes.

What is claimed is:

1. A heat pump system comprising:

a pressure turbine expander having an inlet and an exhaust and being located underground;

a fluid circuit having an exit portion and a return portion, the exit portion connecting to the expander exhaust and the return portion connecting to the expander inlet;

a heat transfer fluid in the fluid circuit;

a means for compressing the heat transfer fluid in the return portion of the fluid circuit comprising gravity, wherein the means for compressing is located at a higher gravitational potential energy then the gravitational potential energy of the expander;

a heat sink located to divide the exit portion from the return portion of the fluid circuit; and a condenser located at a higher gravitational potential energy then the gravitational potential energy of the expander;

a heat source comprising geothermal energy located in the fluid circuit.

2. The heat pump of claim 1 wherein the expander is located at least 100 m beneath the condenser.

3. The heat pump of claim 1 wherein the expander is located at least 1000 m beneath the condenser.

4. A heat pump system comprising:

a pressure turbine expander having an inlet and an exhaust;

a fluid circuit having an exit portion and a return portion, the exit portion connecting to the expander exhaust and the return portion connecting to the expander inlet;

a heat transfer fluid in the fluid circuit;

a means for compressing the heat transfer fluid in the return portion of the fluid circuit;

a heat sink located to divide the exit portion from the return portion of the fluid circuit; and a heat source located in the fluid circuit.

5. The heat pump of claim 4 wherein the means for compressing comprises gravity.

6. The heat pump of claim 5 wherein the heat source comprises geothermal energy and is located in the return portion of the fluid circuit.

7. The heat pump of claim 6 wherein the expander is located at a lower gravitational potential energy then the gravitational potential energy of the means for compressing.

8. The heat pump of claim 7 wherein the heat transfer fluid comprises a refrigerant.

9. The heat pump of claim 7 wherein the heat transfer fluid comprises water.

10. The heat pump of claim 7 wherein the fluid circuit is an open-loop circuit.

11. The heat pump of claim 7 wherein the fluid circuit is a closed-loop circuit.

12. The heat pump of claim 7 wherein the means for compressing further comprises a pressure turbine compressor.

13. The heat pump of claim 4 wherein the means for compressing comprises a pressure turbine compressor.

14. The heat pump of claim 13 further comprising a shaft mechanically coupling the expander to the pressure turbine compressor to maintain the synchronous rotation of the expander and the pressure turbine compressor.

15. The heat pump of claim 14 wherein the heat transfer fluid is fluid is water.

16. The heat pump of claim 15 wherein the heat source comprises geothermal energy.

17. A heat pump system comprising:

a pressure turbine expander having an inlet and an exhaust;

a heat sink;

a pressure turbine compressor having an inlet and an exhaust;

a heat source;

a fluid circuit connecting the expander to the compressor via heat sink and connecting the compressor to the expander via the heat source;

a heat transfer fluid in the fluid circuit; and a shaft mechanically connecting the expander to the compressor to insure synchronous rotation of the expander and the compressor.

18. The heat pump of claim 17 wherein the heat source is solar thermal.

19. The heat pump of claim 17 wherein the shaft insures that the rotation of the expander is out of phase with the rotation of the compressor.

20. The heat pump of claim 19 wherein the heat transfer fluid is fluid is water.

* * * * *